US012185838B1

(12) United States Patent
Sadiq et al.

(10) Patent No.: US 12,185,838 B1
(45) Date of Patent: Jan. 7, 2025

(54) MATTRESS ARRANGEMENTS HAVING CONNECTABILITY

(71) Applicant: Engineered Sleep, LLC, Greenville, SC (US)

(72) Inventors: Raheel Sadiq, Greenville, SC (US); James B. Orders, IV, Greenville, SC (US); Carter R. Mahaffee, Greenville, SC (US)

(73) Assignee: Engineered Sleep, LLC, Greenville, SC (US)

( * ) Notice: Subject to any disclaimer, the term of this patent is extended or adjusted under 35 U.S.C. 154(b) by 0 days.

(21) Appl. No.: 18/521,120

(22) Filed: Nov. 28, 2023

Related U.S. Application Data

(60) Provisional application No. 63/594,725, filed on Oct. 31, 2023.

(51) Int. Cl.
*A47C 27/00* (2006.01)

(52) U.S. Cl.
CPC ..... *A47C 27/002* (2013.01)

(58) Field of Classification Search
CPC ..... A47C 27/002; A47C 31/105; A47C 31/02; A47C 19/045; A47C 27/15; A47G 9/0238; A47G 9/0246; A47G 9/02; A47B 18/0015
See application file for complete search history.

(56) References Cited

U.S. PATENT DOCUMENTS 3,654,059 A * 4/1972 Zisblatt ..... A47G 9/0238 156/289
4,449,261 A 5/1984 Magnusson
4,726,083 A 2/1988 Hoshall
4,955,095 A * 9/1990 Gerrick ..... A47C 31/105 5/691
5,092,010 A * 3/1992 Wong ..... A47G 9/0284 5/493
5,136,741 A 8/1992 Balonik
5,414,882 A 5/1995 Goodale
6,115,861 A 9/2000 Reeder
6,489,004 B1 * 12/2002 Martin ..... A61F 13/627 24/451
7,051,388 B1 5/2006 Taddeo
7,228,581 B2 6/2007 Mezue
8,256,068 B2 * 9/2012 West ..... A44B 18/0065 24/450
8,856,985 B2 10/2014 Rensink et al.
(Continued)

FOREIGN PATENT DOCUMENTS

BR 102014026707 A2 8/2015
CN 205903087 U 1/2017
(Continued)

OTHER PUBLICATIONS

Office Action for U.S. Appl. No. 18/521,261 dated Apr. 25, 2024.
Amendment dated Jul. 25, 2024, for U.S. Appl. No. 18/521,261.

*Primary Examiner* — Justin C Mikowski
*Assistant Examiner* — Alison N Labarge
(74) *Attorney, Agent, or Firm* — JK Intellectual Property Law, PA

(57) ABSTRACT

Mattress arrangements include mattress portions with friction enhancing fabrics to secure them in place. The mattress portions can be bases and toppers, mattresses, and supports, or other components. Use of the fabrics eliminates the need for other attachment structures.

29 Claims, 6 Drawing Sheets

(56) References Cited

U.S. PATENT DOCUMENTS

| | | | | |
|---|---|---|---|---|
| 10,624,464 | B2 | 4/2020 | Shuaib | |
| 11,559,142 | B2 | 1/2023 | Blatt et al. | |
| 11,849,847 | B1 * | 12/2023 | Heath | A47C 27/085 |
| 2008/0010753 | A1 | 1/2008 | Hernandez Maestre | |
| 2013/0212809 | A1 * | 8/2013 | Scarleski | A47C 31/105 5/737 |
| 2013/0269114 | A1 | 10/2013 | Wu | |
| 2014/0096325 | A1 | 4/2014 | Giannopoulos | |
| 2016/0251790 | A1 | 9/2016 | Wakui | |
| 2017/0035214 | A1 | 2/2017 | Srivastava | |
| 2017/0325594 | A1 | 11/2017 | Nishimura | |
| 2017/0340133 | A1 * | 11/2017 | Scarleski | A47C 21/028 |
| 2020/0022504 | A1 * | 1/2020 | Zhang | A47C 20/041 |
| 2021/0120968 | A1 * | 4/2021 | Van Namee | A47C 31/105 |
| 2021/0161302 | A1 | 6/2021 | Al-Hazeem | |
| 2021/0331806 | A1 * | 10/2021 | Dowty | B64D 11/0647 |
| 2023/0067095 | A1 * | 3/2023 | Teller | A47C 27/144 |

FOREIGN PATENT DOCUMENTS

| | | | |
|---|---|---|---|
| CN | 208463409 | U | 2/2019 |
| DE | 202004019935 | | 5/2005 |
| FR | 3003140 | A1 | 9/2014 |
| KR | 20-0237729 | | 9/2001 |
| RU | 51467 | U1 | 2/2006 |
| WO | 2007/002290 | A3 | 1/2007 |
| WO | 2011/072022 | A1 | 6/2011 |

* cited by examiner

MATTRESS ARRANGEMENTS HAVING CONNECTABILITY

CROSS-REFERENCE TO RELATED APPLICATION

The present application is a Non-Provisional Patent Application and claims priority to U.S. Provisional Patent Application Ser. No. 63/594,725, filed Oct. 31, 2023, which is incorporated by reference herein.

TECHNICAL FIELD

The present disclosure relates generally to mattresses, mattress components, and mattress arrangements with one or more components that provide benefits relating to connectability.

BACKGROUND

Mattress and bed designs have evolved over the years. At one time in the United States, a very common bed type included a bed frame on the bottom, a box-spring base mattress (having springs inside a rigid lumber frame, all surrounded by fabric), and an innerspring mattress on the top. While such beds are still quite popular, mattress and bed design have both evolved in many ways. Many more options are now available such as pillowtop mattresses, two-part (separable and non-separable) top or full system mattresses, foam mattresses, airbladder mattresses, adjustable bed frames, vibrating bed frames, platform bed frames, modular mattresses with custom selectable mattress base and/or topper portions, one-piece mattresses, etc.

For beds with two or more stacked mattress components (whether conventional box-spring/inner spring type or other designs), upper and lower components are often attached together in some way to prevent relative sliding of the top component relative to the bottom component. Vertically-connecting structures have been used to connect such components using flaps, straps, snaps, hooks, rings, zippers, ties, elastic, or hook and loop fastener (e.g., Velcro®) squares. U.S. Pat. No. 10,624,464 B2, U.S. Pat. No. 8,856,985 B2, U.S. Pat. No. 4,449,261, and WO2011/072022 A1, for example, show multi-component mattresses with some sort of vertically-connecting structure(s) to secure together respective vertically-stacked components. The ES DUO™ mattress available from Engineered Sleep Mattress Company is an example of an existing mattress arrangement with pocketed coils in a mattress base and a foam mattress topper, the base and topper being securely and removably attached together by zippers along outsides of the mattress base and the mattress topper. Similar attachment may be required to secure in place one-piece mattresses, cushions, etc., which are placed atop and/or secured to a structure that is not another mattress or mattress portion.

Although these mattress systems work well for their intended purposes, the connectors of some such systems (especially conventional Velcro® fasteners) are often undesirably noisy when the user simply moves around on the bed or when the bed frame is repositioned. Also, the presence and use of such connectors of such stacked component mattresses add expense in terms of added materials and manufacturing steps, and add steps to assembly or set-up of such a bed for the user. Further, the relatively fixed and/or non-adjustable connection between stacked mattress components can be problematic in that the relatively small connectors or their contact/attachment points with the mattress components (whether distributed within facing surfaces or along edges of facing surfaces) require precise alignment to be functional. Such structures are also points of high stress and potential failure—where the glued-on or stitched-on connectors might tear off and/or tear the mattress components' outer fabric. Such problems may be exacerbated in adjustable or vibrating bed systems where orientation of the mattress components change and/or some small amount of (controlled) movement or deformation is desired between at least some parts of the components.

Accordingly, improvements in bed designs would be welcome, addressing one or more of the above drawbacks of existing systems and/or providing one or more other benefits for mattresses, mattress components, and mattress assemblies.

SUMMARY

According to certain aspects of the disclosure, a mattress arrangement may include, for example, a mattress base having a length, a width, and a top surface having a mattress base area defined by the mattress base length and the mattress base width, the mattress top surface including a mattress base top fabric; a mattress topper having a length, a width, a weight, and a bottom surface having a mattress topper area defined by the mattress topper length and the mattress topper width, the mattress topper bottom surface including a mattress topper bottom fabric, the mattress topper configured to be placed atop the mattress base in a use position so that the bottom surface of the mattress topper rests on the top surface of the mattress base; a first friction enhancing fabric located on the mattress base top surface; and a second friction enhancing fabric located on the mattress topper bottom surface. The first friction enhancing fabric, the second friction enhancing fabric, and the weight of the topper are configured to cooperate to frictionally oppose sliding of the mattress topper relative to the mattress base when a lateral force is applied to the mattress topper so that the mattress topper is not removable from the mattress base without at least partially lifting the mattress topper off the base. A duo of the first friction enhancing fabric and the second friction enhancing fabric define a higher coefficient of friction than a duo of the mattress base top fabric and the mattress topper bottom fabric. Various options and modifications are possible.

For example, the first friction enhancing fabric may define a first friction enhancing fabric area, and the second friction enhancing fabric defines a second friction enhancing fabric area, and if so at least one of: the first friction enhancing fabric area is less than the mattress base area, and the second friction enhancing fabric area is less than the mattress topper area. Additionally or alternatively, the first friction enhancing fabric area and the second friction enhancing fabric area are substantially identical and are aligned when the mattress topper and the mattress base are in the use position. If desired, at least one of: the first friction enhancing fabric area is at least 5% as large as the mattress base area, and the second friction enhancing fabric area is at least 5% as large as the mattress topper area. Further, it is possible that at least one of the first friction enhancing fabric area and the second friction enhancing area comprise one continuous area.

If desired, the mattress base is an adjustable mattress base locatable on an articulatable mattress support, the mattress base defining at least one pivot point extending across the width of the mattress base, the first friction enhancing fabric extending lengthwise above and below the at least one pivot point. Also, in some embodiments, at least one of: the first friction enhancing fabric area is coextensive with the mattress base area, and the second friction enhancing fabric area is coextensive with the mattress topper area.

The first friction enhancing fabric and the second friction enhancing fabric may have an apparent static coefficient of friction of at least about 2.0 when tested laterally according to ASTM-D1894-14, or about 8.5, or about 6.3 to about 9.5.

In some embodiments, the first friction enhancing fabric and the second friction enhancing fabric each have a unit weight less than about 400 gsm and a thickness of less than about 6.0 mm, or a unit weight less than about 300 gsm and/or a thickness of about 1.0 mm.

The first friction enhancing fabric length may be about 60 inches.

The first friction enhancing fabric and the second friction enhancing fabric may each comprise polyester fabrics, and one of the first friction enhancing fabric and the second friction enhancing fabric may comprise a hook fabric, which may be a unidirectional hook fabric, whereas the other of the first friction enhancing fabric and the second friction enhancing fabric comprises a fabric frictionally engageable by the hook fabric.

At least one of the mattress base and the mattress topper may be configured to be so that the top surface can be oriented upwardly or downwardly and additional friction enhancing fabrics are provided on respective bottom surface(s). If desired, the arrangement con be configured so that the mattress base has a bottom surface, the mattress base having a first firmness when in a first orientation with the top surface facing upward to contact the bottom surface of the mattress topper and a second firmness different from the first firmness when in a second orientation with the bottom surface facing upward to contact the bottom surface of the mattress topper, the mattress base bottom surface having a third friction enhancing fabric comprising at least a portion of the mattress base bottom surface for contacting second friction enhancing fabric to cooperate to oppose sliding of the mattress topper relative to the mattress base when a lateral force is applied to the mattress topper when in the second orientation.

If desired, the first friction enhancing fabric is attached to the mattress base top fabric, and the second friction enhancing fabric is attached to the mattress topper bottom fabric, in both cases by at least one of: an adhesive or stitching.

According to other aspects of the disclosure, a mattress arrangement may include, for example, a mattress base having a length, a width, and a top surface having a mattress base area defined by the mattress base length and the mattress base width; a mattress topper having a length, a width, a weight, and a bottom surface having a mattress topper area defined by the mattress topper length and the mattress topper width, the mattress topper configured to be placed atop the mattress base in a use position so that the bottom surface of the mattress topper rests on the top surface of the mattress base; a first friction enhancing fabric having an area covering at least a portion of the mattress base top surface; and a second friction enhancing fabric having an area covering at least a portion of the mattress topper bottom surface. The first friction enhancing fabric, the second friction enhancing fabric, and the weight of the topper are configured to cooperate to oppose sliding of the mattress topper relative to the mattress base when a lateral force is applied to the mattress topper. The first friction enhancing fabric and the second friction enhancing fabric have an apparent static coefficient of friction of at least about 2.0 when tested according to ASTM-D1894-14. As above, various options and modifications are possible.

For example, the apparent static coefficient of friction may be about 8.5, or about 6.3 to about 9.5. The first friction enhancing fabric and the second friction enhancing fabric may each have a unit weight less than about 400 gsm and a thickness of less than about 6.0 mm, or a unit weight less than about 300 gsm and/or a thickness of about 1.0 mm. The first friction enhancing fabric and the second friction enhancing fabric may each comprise polyester fabrics, and one of the first friction enhancing fabric and the second friction enhancing fabric may comprise a hook fabric, which may be unidirectional.

According to other aspects of the disclosure, a mattress arrangement may include, for example, a mattress base having a length, a width, and a top surface having a mattress base top area defined by the mattress base length and the mattress base width and a bottom surface having a mattress base bottom area defined by the mattress base length and the mattress base width; a mattress topper having a length, a width, a weight, and a bottom surface having a mattress topper area defined by the mattress topper length and the mattress topper width, the mattress topper configured to be placed atop the mattress base in a use position so that the bottom surface of the mattress topper rests on the top surface or the bottom of the mattress base; a first friction enhancing fabric having an area covering at least a portion of the mattress base top surface; a second friction enhancing fabric having an area covering at least a portion of the mattress topper bottom surface; and a third friction enhancing fabric having an area covering at least a portion of the mattress base bottom surface. The first friction enhancing fabric, the second friction enhancing fabric, and the weight of the topper may be configured to cooperate to oppose sliding of the mattress topper relative to the mattress base when a lateral force is applied to the mattress topper with the first friction enhancing fabric facing upward. The third friction enhancing fabric, the second friction enhancing fabric, and the weight of the topper may be configured to cooperate to oppose sliding of the mattress topper relative to the mattress base when a lateral force is applied to the mattress topper with the third friction enhancing fabric facing upward. The mattress base may have a first firmness when in a first orientation with the top surface facing upward to contact the bottom surface of the mattress topper and a second firmness different from the first firmness when in a second orientation with the bottom surface facing upward to contact the bottom surface of the mattress topper. Again, various options and modifications are possible.

For example, the first friction enhancing fabric and the second friction enhancing fabric may have an apparent static coefficient of friction of at least about 2.0 when tested according to ASTM-D1894-14, and the apparent static coefficient of friction may be about 8.5, or about 6.3 to about 9.5. The first friction enhancing fabric and the second friction enhancing fabric may each have a unit weight less than about 400 gsm and a thickness of less than about 6.0 mm, or a unit weight less than about 300 gsm and/or a thickness of about 1.0 mm.

The first friction enhancing fabric and the second friction enhancing fabric may each comprise polyester fabrics, and one of the first friction enhancing fabric and the second friction enhancing fabric comprises a unidirectional hook fabric.

According to certain other aspects of the disclosure, a mattress arrangement is disclosed for use with an external friction enhancing fabric on a support, the mattress arrangement may include, for example, a mattress section having a length, a width, and a top surface having a mattress top area defined by the mattress section length and the mattress section width and a bottom surface having a mattress bottom area defined by the mattress section length and the mattress section width; a first friction enhancing fabric comprising at least a portion of the mattress section bottom surface; the mattress section configured to be placed atop the external friction enhancing fabric on the support in a use position so that the bottom surface of the mattress section rests on the external friction enhancing fabric. The first friction enhancing fabric, the external friction enhancing fabric, and the weight of the mattress section may be configured to cooperate to oppose sliding of the mattress section relative to the external friction enhancing fabric when a lateral force is applied to the mattress section. As above, various options and modifications are possible.

For example, the first friction enhancing fabric area may be at least 5% as large as the mattress bottom area, and also may be as large as coextensive with the mattress bottom area. The first friction enhancing fabric and the external friction enhancing fabric may have an apparent static coefficient of friction of at least about 2.0 when tested according to ASTM-D1894-14, or about 8.5, or about 6.3 to about 9.5. The first friction enhancing fabric and the external friction enhancing fabric may each have a unit weight less than about 400 gsm and a thickness of less than about 6.0 mm, or a unit weight less than about 300 gsm and/or a thickness of about 1.0 mm.

If desired, a kit may be provided including the mattress above and the external friction enhancing fabric for attachment, for example to a provided or preexisting support.

BRIEF DESCRIPTION OF THE DRAWINGS

More details of the present disclosure are set forth in the drawings.

DETAILED DESCRIPTION

Figure 1:
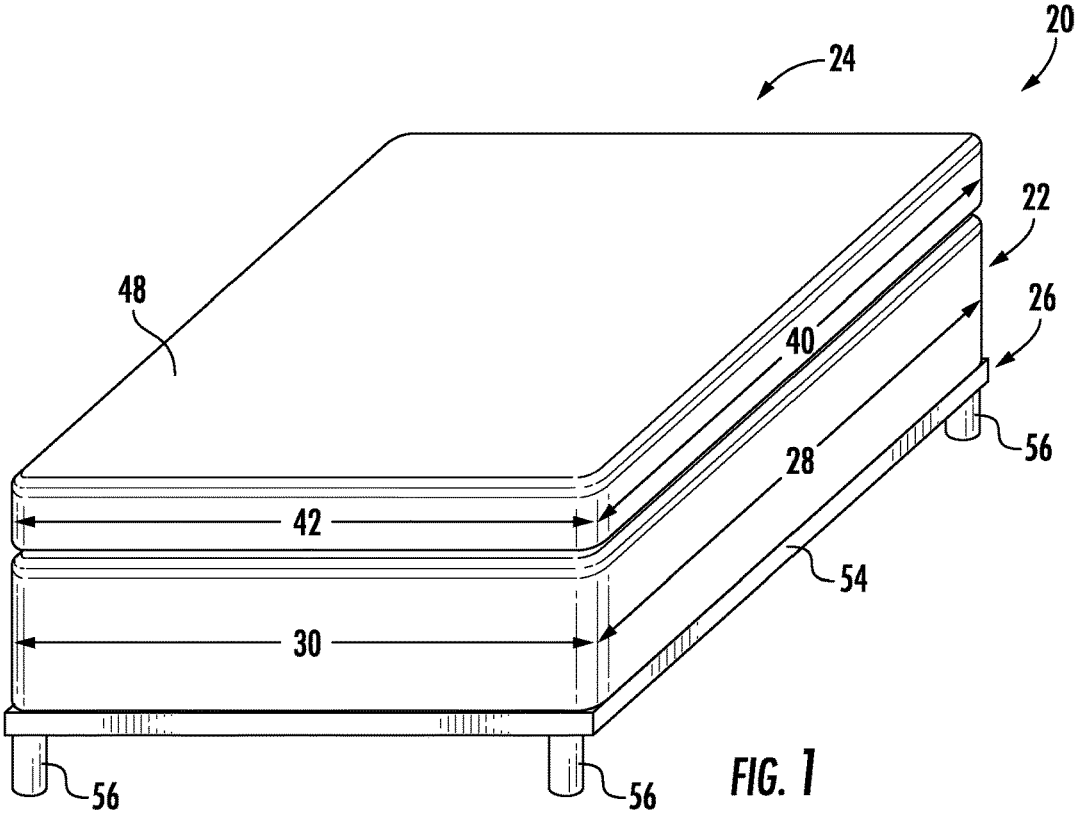
FIG. 1 is an isometric view of a mattress arrangement according to a first embodiment of the disclosure, and having a mattress base and a mattress topper, both located atop an optional movable support.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

Generally speaking, the following disclosure is related to aspects of bedding, padding, and/or cushioning, such as one-piece or multi-piece mattress/cushion arrangements, where reasonably lightweight, smooth, and silent friction-enhancing fabrics are employed to secure one or more portions together and/or to another structure such as a support. Therefore, in view of the above, several embodiments are shown and described, and/or summarized above, although the mattress concepts of the present disclosure have broader applications and usages than the following embodiments themselves.

Figure 2:
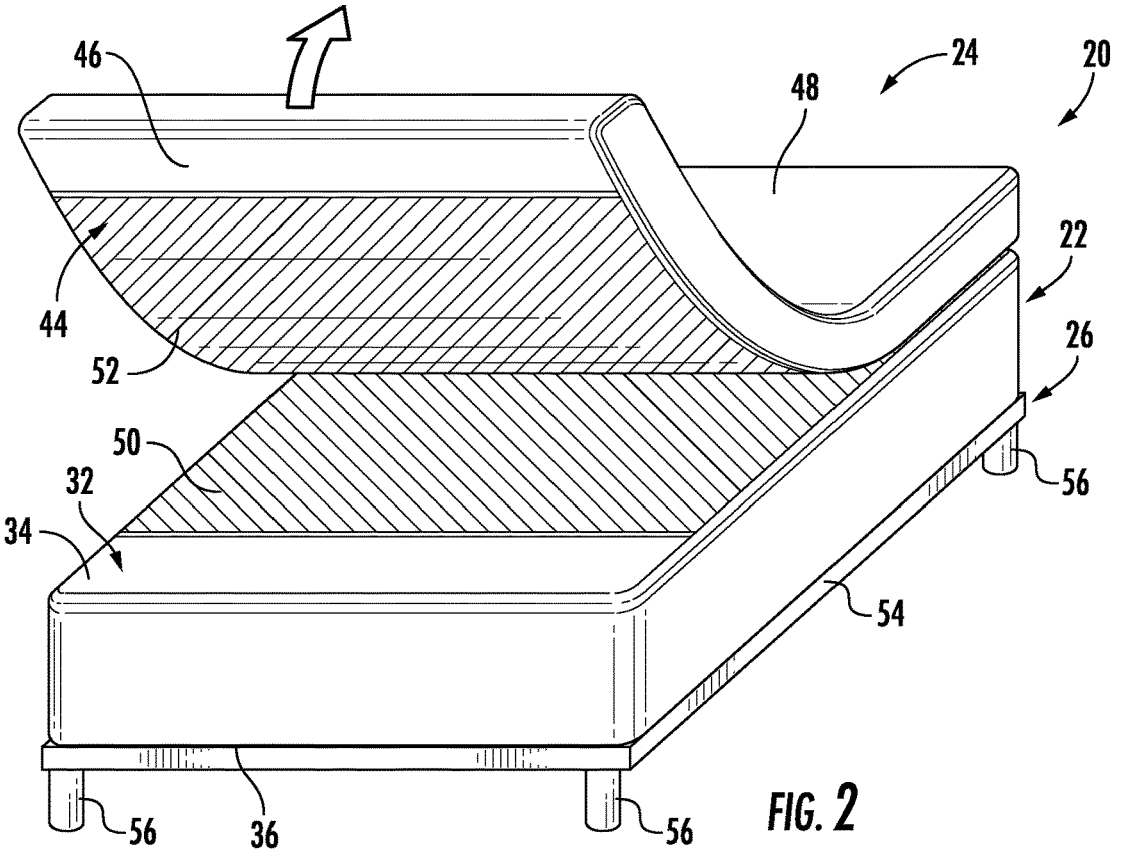
FIG. 2 is an isometric view as in FIG. 1, showing the mattress topper partially lifted up so that first and second friction-enhancing fabrics on the mattress base and the mattress topper are visible.

FIGS. 1 and 2 show a mattress arrangement 20 according to a first embodiment of the disclosure and having a mattress base 22 and a mattress topper 24, both located atop an optional (and optionally movable) support 26. As illustrated, mattress base 22 and topper 24 may of any conventional two-part mattress arrangement, such as box spring and top mattress, pocket coil mattress and foam topper, etc. The components may be any of the conventional mattress constructs, including elements such as coil springs, frames, foam, fire retardant layers, padding, seams, piping, handles, stitching, adhesives, etc. The components may be configured to be fixed and/or able to be adjusted in orientation when placed on a movable frame. The components may also be used in locations such as boats, RV's, truck cabs, furniture other than bedding, etc., and may in some aspects comprise cushions or padding of fixed or movable furniture as opposed to bedding per se.

That said, as an example strictly for discussion herein, the interior components of mattress base 22 and mattress topper 24 of FIGS. 1 and 2 may include structures as found in an ES DUO™ mattress. Support 26 may comprise a movable support such as the ES Power Bed Base™ or a fixed support such as the ES Luxe Bed Foundation™, both also available from Engineered Sleep Mattress Company.

Mattress base 22 has a length 28, a width 30, and a top surface 32 having a mattress base area defined by the mattress base length and the mattress base width. Mattress top surface 32 is covered by a fabric 34 which may be for example a conventional fire-resistant fabric layer (meeting legal/regulatory requirements) or other fabric. A bottom surface 36 rests on support 26.

Similarly, mattress topper 24 has a length 40, a width 42, a weight, and a bottom surface 44 having a mattress topper area defined by the mattress topper length and the mattress topper width. Mattress topper bottom surface 44 includes a mattress topper bottom fabric 46 (which may again be fire-resistant or other fabric). Mattress topper 24 also has a top surface 48 on which covering, sheets, or bedding would be placed, wherein a person would rest on such layer. Alternatively, another layer could be placed atop the mattress topper. Mattress topper 24 is configured to be placed atop mattress base 22 in a use position so that bottom surface 46 of the mattress topper 24 rests on top surface 32 of mattress base 22.

A first friction enhancing fabric 50 is located on mattress base top surface 32, a second friction enhancing fabric 52 is located on mattress topper bottom surface 44 (see FIG. 2 wherein a portion of fabrics 50 and 52 are visible). The location and the characteristics of the fabrics 50 and 52, as well as the configuration and construction of base 22 and topper 24 are such that lateral movement of topper off base is opposed, without need for further securing attachment structures such as mentioned above.

In other words, the fabrics 50 and 52 cooperate to maintain topper 24 in place on base 22 in normal usage without need for conventional snaps, hooks, zippers, Velcro straps, buttons, elastic banding, etc., extending between topper and base. Also, fabrics 50 and 52 are light and silent enough that movement of a person on the bed and/or movement of the support do not create relatively loud noises made by Velcro straps during repositioning of same (laterally or vertically). Further, fabrics 50 and 52 are readily separable by lifting topper off mattress so that, when desired, the parts may be readily separated by lifting to reduce areas of contact between fabrics, then sliding (for example, for cleaning, replacements of sheets or covering reversal, modular adjustment, etc.). One or more characteristics of fabrics 50 and 52 that may allow such performance will be described below after description of the various embodiments showing how and where such fabrics may be employed in various mattress arrangements.

Thus, it can be said that first friction enhancing fabric 50, second friction enhancing fabric 52, and the weight of topper 24 are configured to cooperate to frictionally oppose sliding of topper 24 relative to base 22 when a lateral force is applied to the topper so that the topper is not removable from the base without at least partially lifting the topper off the base. Further, the duo of the first friction enhancing fabric and the second friction enhancing fabric define a higher coefficient of friction than a duo of the mattress base top fabric and the mattress topper bottom fabric to allow such function.

FIGS. 3A to 3H show some (but not all) examples of how fabrics 50 and 52 can be arranged on base 22 and topper 24 respectively. In each case, the representation shows the base from above (looking down at its top surface), with the topper peeled off and flipped over (to the left, looking down at its bottom surface).

Figure 3A:
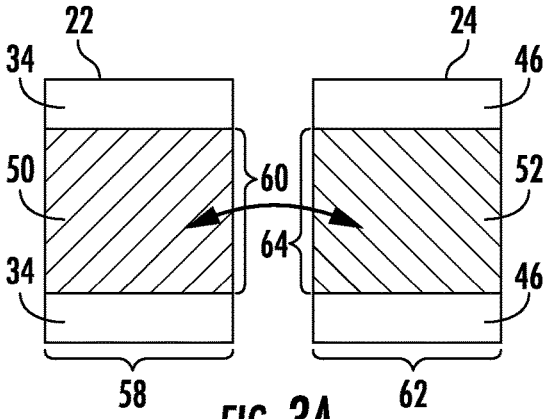
FIGS. 3A to 3H are each plan views of the mattress arrangement as in FIG. 1, showing examples of some of the possible arrangements of friction enhancing fabrics on facing surfaces of a mattress base and a mattress topper.

FIG. 3A shows the fabrics 50 and 52 as illustrated in FIGS. 1 and 2. Note that fabric 50 has a width 58 equal to that of mattress base 22 (which may be any conventional size mattress such as single, twin, queen, king, split, partially split, etc., or any other size). Similarly, fabric 52 has a width 62 equal to that of topper and equal to width 58. Fabric 50 has a length 60 less than that of base 22, and fabric 52 has a length 64 less than that of topper 64 and equal to length 60. It is believed that lengths 60 and 64 may be at least 5% of the lengths of base 22 and topper 24 (and similarly at least 5% for the areas of fabrics and components) for sufficient connection. If desired, the arrangement of fabrics 50 and 52 covering (only) some of the length of the base and topper could be switched to cover (only) some of the width of the base and topper.

As a point of reference for two common bed sizes, queen size beds are 60" (w)×80" (l), and king size are 76" (w)×80" (l). Lengths 60 and 64 may be much higher if desired. For example, fabrics 50 and 52 could be single or multiple (see below) strips having at least 10, 20 or 50% of the length of the mattress components for greater connection. Such may be more useful on adjustable beds, but applicability to non-adjustable beds exists as well. If fabrics 50 and 52 are available in sheets or rolls of standard textile sizes such as 36", 48", 60", etc., such fabrics may be simply cut to the width of portions 22 and 24 (e.g., 60", 76") and attached to portions 22 and 24, for example via sewing, adhesive, lamination, etc. As shown in FIGS. 2 and 3A, fabrics 50 and 52 are coextensive and cover over 50% of the surfaces on which they are applied. If fabrics 50 and 52 are 60" in length, then the coverage is about 79% for the queen bed and about 75% for the king bed.

Figure 3B:
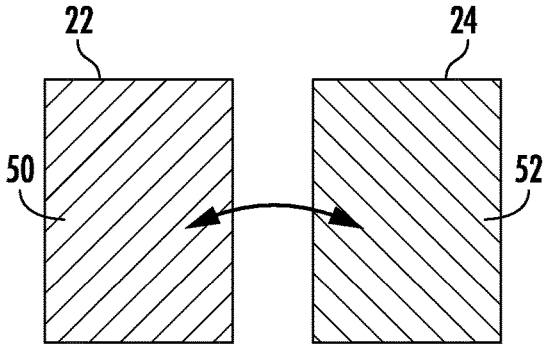

FIG. 3B shows that fabrics 50 and 52 may if desired both cover all of base 22 and topper 24 respectively.

Figure 3C:
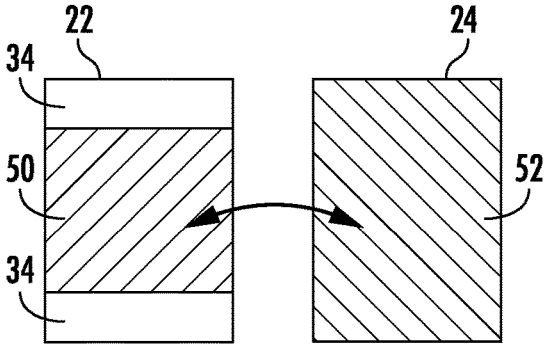
Figure 3D:
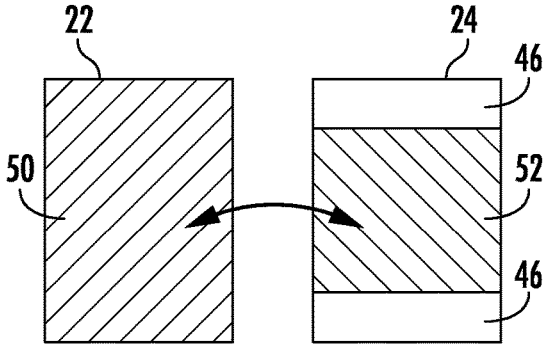

FIG. 3C shows that fabrics 50 and 52 may cover differing areas, fabric 50 approximating that of FIG. 3A and fabric 52 approximating that of FIG. 3B. FIG. 3D reverses the arrangement of FIG. 3C.

Figure 3E:
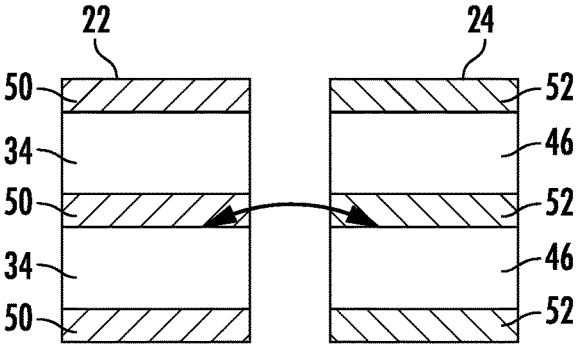

FIG. 3E shows that one or both fabrics 50 and 52 may be formed discontinuously, in this case each in three coextensive spaced apart lateral pieces, formed as long, thin strips. If should be understood such pieces could have other shapes, other numbers of pieces could be employed, the pieces need not be parallel strips, the pieces could intersect or overlap, the pieces could be curved or irregularly shaped. Again, it is believed that about at least 5% coverage (overlapping) by fabrics 50 and 52, if not more, will aid with securing base 22 to topper 24.

Figure 3F:
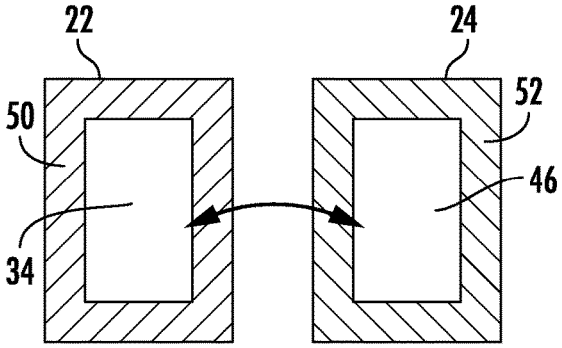

FIG. 3F shows that fabrics 50 and 52 may be laid around edges of parts 22 and 24 rectangularly, formed from one or more pieces of material, rather than in strips.

Figure 3G:
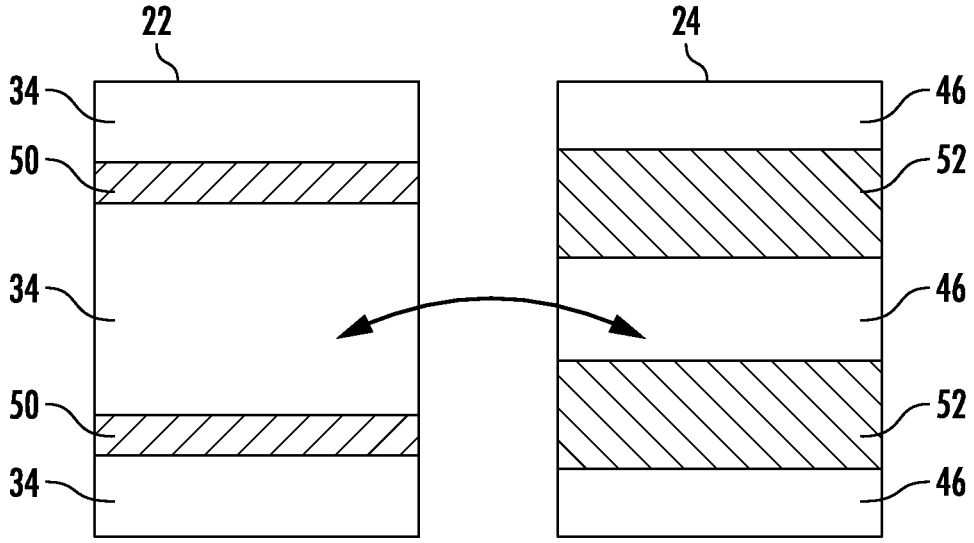

FIG. 3G shows that fabrics 50 and 52 may be similarly arranged but not coextensive, as the two fabric strips 52 have a larger lengthwise dimension than the two fabric strips 50. Such may allow for keeping the base and topper securely connected in case of minor misalignment and/or for use with a movable support where some minimal amount of relative sliding and deformation of base and/or topper would naturally occur.

Figure 3H:
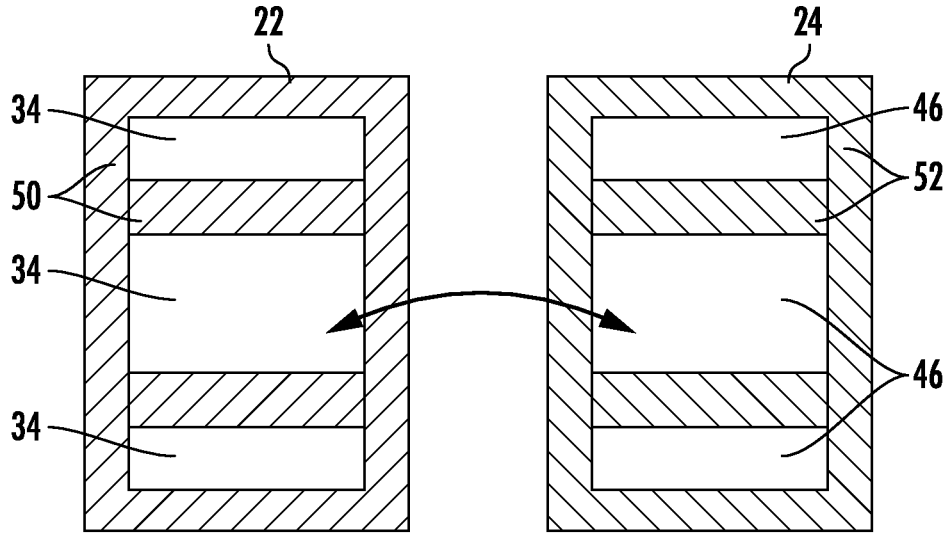

FIG. 3H shows that fabrics 50 and 52 may include elements extending across (widthwise as shown, and/or lengthwise) and around the perimeter of base 22 and topper 24.

Many other arrangements of fabrics 50 and 52 beyond the few exemplary arrangements above can be created following the above teachings, modifying them, combining them, etc., all within the scope of the present disclosure.

Figure 4:
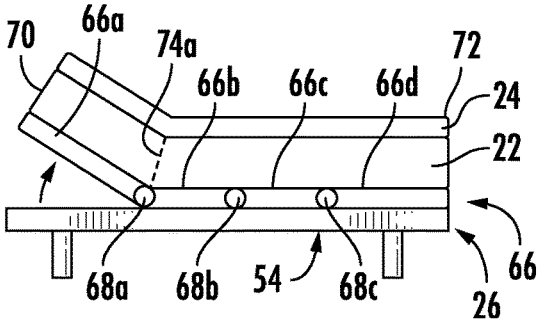
FIG. 4 is a side diagrammatic view of the mattress arrangement as in FIG. 1 with the head end raised via the support.
Figure 5:
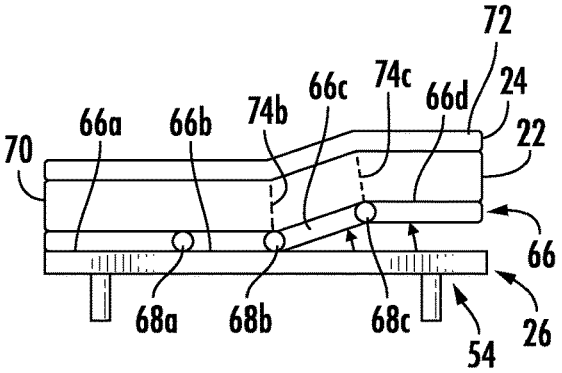
FIG. 5 is a side diagrammatic view of the mattress arrangement as in FIG. 1 with the foot end raised via the support.
Figure 6:
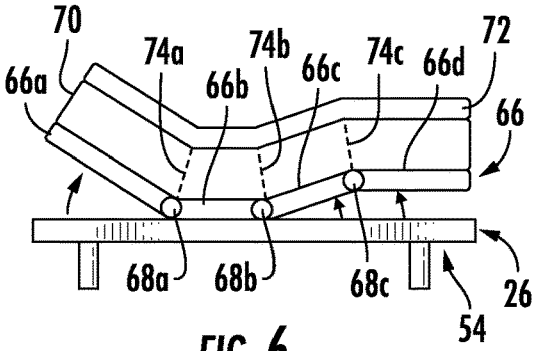
FIG. 6 is a side diagrammatic view of the mattress arrangement as in FIG. 1 with the head end and the foot end raised via the support.

FIGS. 4-6 show (in side diagrammatical view) an example of how support 26 acting as a movable support can adjust the head and/or foot position of base 22 and topper 24. As shown therein support 26 includes a fixed frame portion 54 attached to legs 56 and a movable frame portion 66 comprising portions 66*a-d*. Portions 66*a-d* pivot relative to pivot points 68*a-c* that extend laterally across the wide of base 22 and topper 24. Conventional, hydraulic, pneumatic or servo, other mechanisms (not shown here for brevity) can be employed to adjust portions of movable frame portion 66, as desired.

In FIG. 4, head end 70 is raised; in FIG. 5, foot end 72 is raised; and in FIG. 6, both head end 70 and foot end 72 are raised. Note that pivot points 74*a-c* in mattress base 22 also pivot and flex when pivot points 68*a-c* are moved. It should be understood that instead of three pivot points 68*a-c*, only one or two, or more than two, of such pivot points may be employed. It may be useful in some embodiments to have one or more pieces of fabrics 50 and 52 located on both sides of each pivot point formed in mattress base 22, whether in separate pieces or in one larger piece extending on both sides of each pivot point, to help hold the base and topper securely together when the bed orientation is adjusted.

Figure 7:
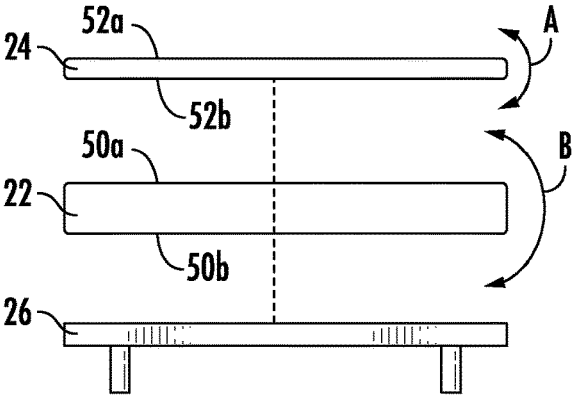
FIG. 7 is an exploded diagrammatic view of a mattress arrangement as in FIG. 1, but wherein the mattress base and/or the mattress topper are reversible for creating mattress arrangements of differing characteristics, the reversible portions(s) each including friction enhancing fabric on both opposing surfaces.

FIG. 7 is an exploded diagrammatic view of a mattress arrangement as in FIG. 1, but wherein the mattress base 22 and/or the mattress topper 24 are reversible for creating mattress arrangements of differing characteristics, the reversible portions(s) each including friction enhancing fabric 50*a,b* and 52*a,b* on both opposing surfaces. Thus, topper 24 can be flipped over (arrow A) to place fabric 52*a* or 52*b* downwards towards base 22. Similarly or alternatively, base 22 can be flipped over (arrow B) to place fabric 50*a* or 50*b* upwards towards topper 24. This can be useful if base 22 and/or topper 24 have different characteristics such as firmness, surface softness, etc., in opposite orientations. Also, this could be useful to extend the life of either component by rotating positioning.

Figure 8:
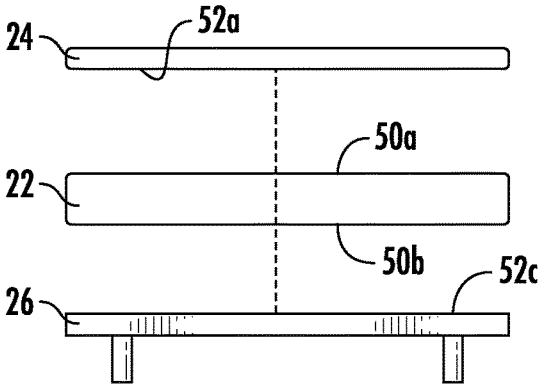
FIG. 8 is an exploded diagrammatic view of a mattress arrangement as in FIG. 1, but wherein friction-enhancing fabrics are also employed between the mattress base contacting the support and the support itself.

FIG. 8 is an exploded diagrammatic view of a mattress arrangement as in FIG. 1, but wherein friction-enhancing fabrics are also employed between the mattress base contacting the support and the support itself. Thus, fabrics 52*a* and 50*a* are located as noted earlier between topper 24 and base 22. A second set of friction enhancing fabrics 50*b* and 52*c* help secure base 22 to support 26.

Figure 9:
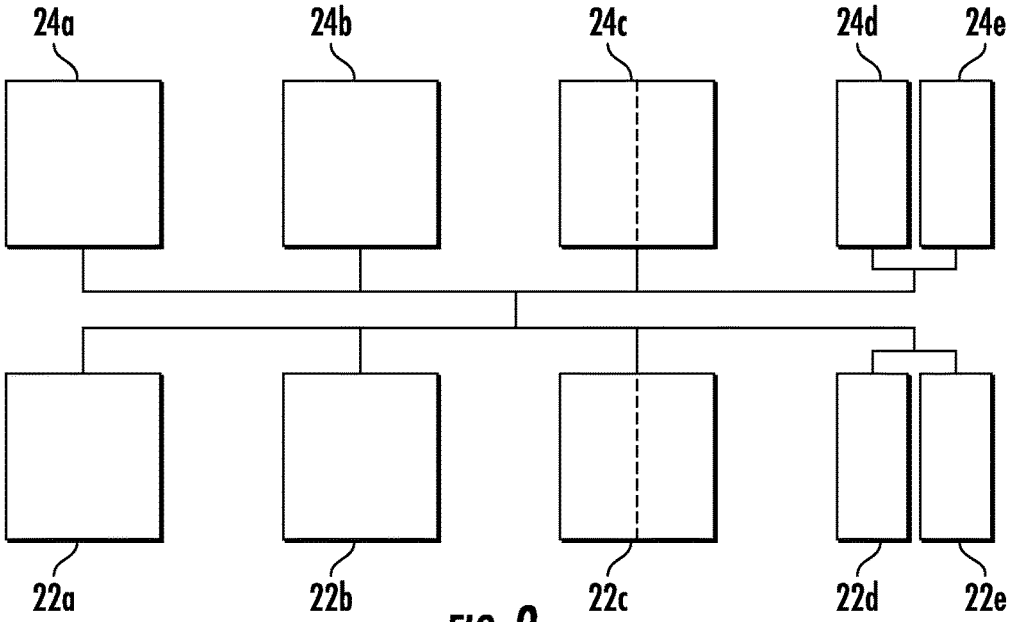
FIG. 9 is a diagrammatic view of a system with at least two mattress bases and/or at least two mattress toppers as in FIG. 1, the system being modular for creating mattress arrangements of differing characteristics.

FIG. 9 is a diagrammatic view of a system with at least two mattress bases and/or at least two mattress toppers as in FIG. 1, the system being modular for creating mattress arrangements of differing characteristics. Thus, if desired, a family of different types of toppers 24*a-e* may be employed with a family of different types of bases 22*a-e*. Thus, for example, base 22*a* may be firm, base 22*b* may be softer, base 22*c* may have a laterally firmer side and a laterally softer side, and bases 22*d, e* may be smaller (perhaps of different firmness) and combinable to form a larger base. Similarly, topper 24*a* may have a first firmness or thickness, 24*b* may have a second firmness or thickness, topper 24*c* may have laterally different firmness or thickness, and toppers 24*d,e* may be combinable to form a larger topper. Providing friction enhancing fabrics 50 and 52 on such components 22*a-e* and 24*a-e* provides easy mix-and-match modularity, customization, and alteration of mattresses as desired to suit many preferences.

Figure 10:
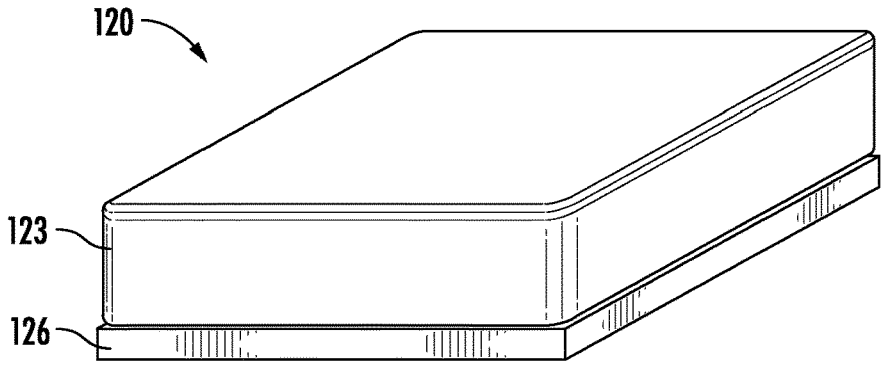
FIG. 10 is an isometric view of a mattress arrangement according to a second embodiment of the disclosure, and having a support and a one-piece mattress.
Figure 11:
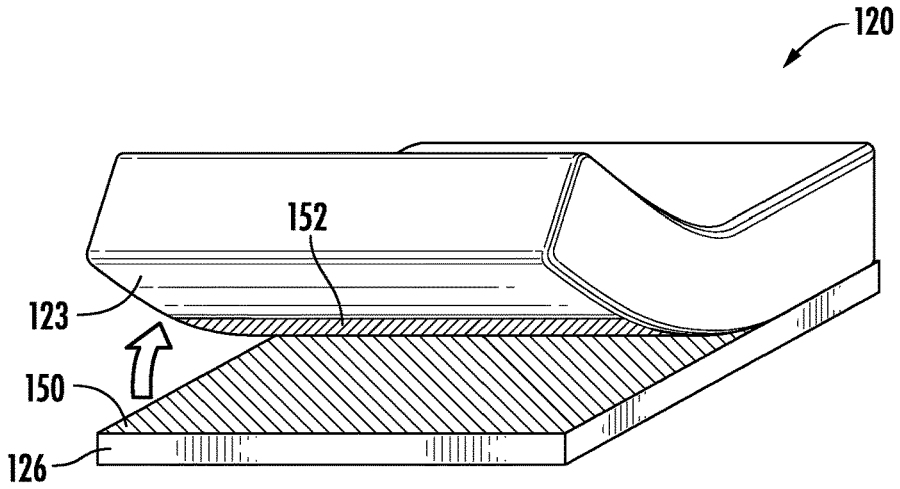
FIG. 11 is an isometric view of the embodiment of FIG. 10, showing the one-piece mattress partially lifted up so that first and second friction-enhancing fabrics on the mattress and the support are visible.

FIGS. 10 and 11 are isometric views similar to those of FIGS. 1 and 2, but wherein the mattress arrangement 120 includes a support 126 and a one-piece mattress 123. The one piece mattress 123 can be more akin to mattress base 22 or mattress topper 24, depending on application. Thus, one-piece mattress 123 could be mattress on a raised platform, or it could be a cushion on a surface in a boat, RV, or vehicle (tractor-trailer cab, e.g.,). (Note, when used herein and in the claims, unless expressly set forth, mattress, mattress portion, mattress base, mattress topper, etc. could refer to any such cushion or related item which is not a mattress per se in common idiom). Mattress 123 includes friction enhancing fabric 152 and friction enhancing fabric 150 is located on support 126. As shown fabrics 150 and 152 are not coextensive but they could be. Fabric 150 may cover all of support 126 upon which mattress 123 rests. Also, the depicted a sheet of fabric 150 may be supplied as a kit with mattress 123 (with fabric 152 already installed on mattress or also separate for installation on mattress by the user), so that a user could install same in a vehicle, building, or other desired location.

Figure 12:
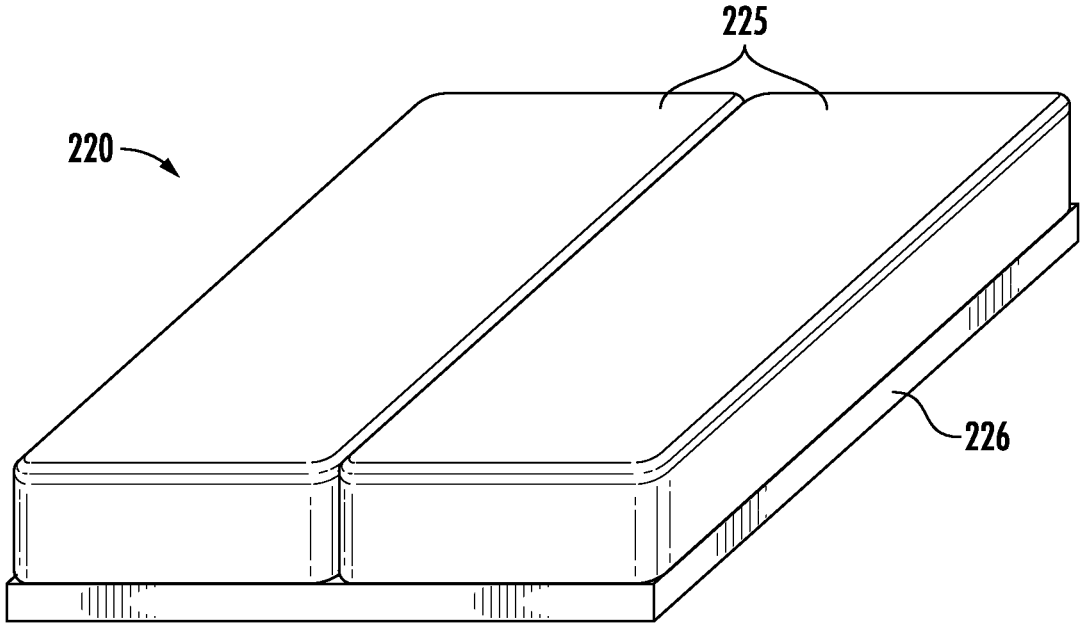
FIG. 12 is an isometric view of a mattress arrangement according to a third embodiment of the disclosure, and having a support and two horizontally adjacent mattress portions.
Figure 13:
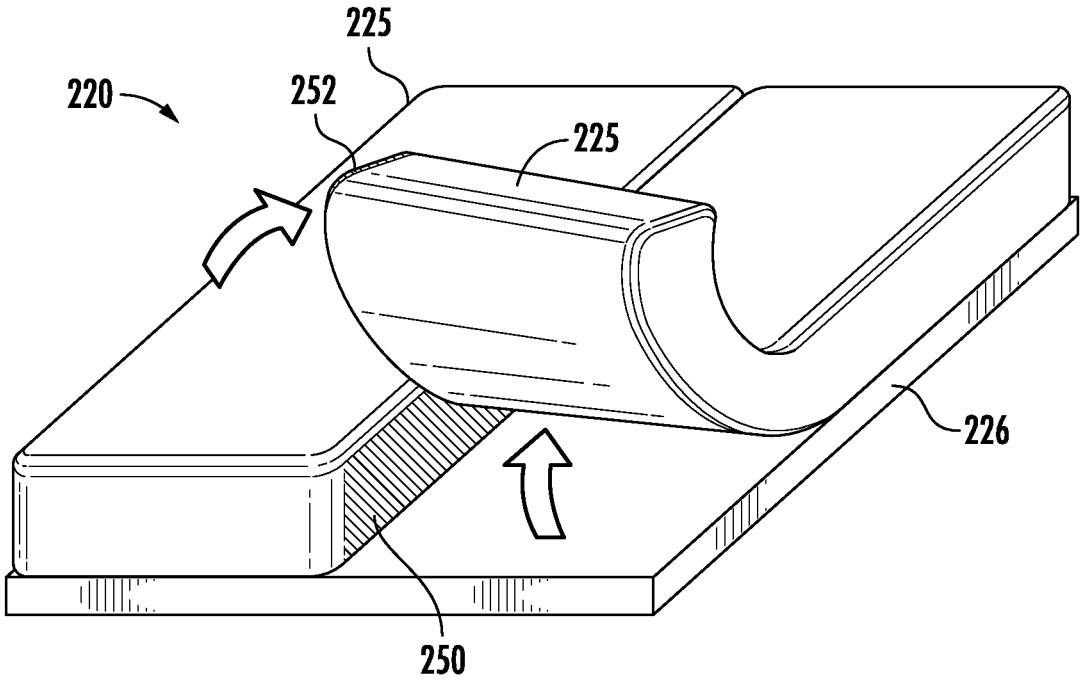
FIG. 13 is an isometric view of the embodiment of FIG. 12, showing one of the mattress portions partially lifted up so that first and second friction-enhancing fabrics on the mattress portions are visible.

Finally, FIGS. 12 and 13 show a mattress arrangement 220 according to a third embodiment of the disclosure, and having a support 226 and two horizontally adjacent mattress portions 225 wherein first and second friction-enhancing fabrics 250, 252 are located on lateral sides of the mattress portions to help secure them together.

It should be understood that all of the above structures are exemplary only, and that modifications and variations of them are within the scope of the present disclosure. Further aspects of the different embodiments can be combined, or mixed and matched to reach new embodiments.

To better understand certain aspects of the disclosure, some examples of suitable materials and numerical testing of same are set forth below.

Applicant had testing conducted under ASTM-D1894-14 (Standard Test Method for Static and Kinetic Coefficients of Friction of Plastic Film and Sheeting). Five tests were performed on complimentary 250 mm×125 mm friction enhancing fabrics consisting of relatively lightweight polyester unidirectional hook and loop fabrics. The fabrics both had a unit weight (grammage) of 270 gsm. The hook fabric yarn was a 100Dsea-islandfilament+200/96DTY, and the loop fabric yarn was a 200D.96D DTY+100d/48 F DTY. The hook fabric had a thickness of about 1.0 mm and the loop fabric had a thickness of about 0.9 mm. Using a sled mass of approximately 452 g, five tests were run under the ASTM standard.

The Apparent Static Coefficient of Friction for the five tests were 9.53, 6.34, 8.70, 8.65, and 9.17 for an average of 8.48 and a standard deviation of 1.25. Based on Applicant's knowledge and experience with fabrics and mattresses, it its believed that application of such friction enhancing fabrics as used in prototypes as configured in FIGS. 1-2 would be suitable for commercial use. Applicant further believes based on knowledge and experience that alternative friction enhancing fabrics, whether hook-and-loop pairs or other fabrics, having lower Static Coefficients of Friction would be suitable. For example, a coefficient of at least 2.0 would be expected to perform satisfactorily, whereas a coefficient of at least 4.0 or higher would provide even more and yet still suitable grip.

Applicant also performed several peel tests, at 6 cm distance, using samples of the friction enhancing fabrics tested according to the ASTM standard and using some conventional multidirectional, relatively thicker Velcro® samples. The peel testing showed the friction enhancing fabrics to be substantially quieter than the Velcro® samples in terms of average (about 82 dB and about 49 dB) and maximum (about 92 dB vs about 55 dB) sound level. Although this test was not an ASTM designated test, Applicant submits it shows that friction enhancing fabrics tested herein are quieter and more uniformly so when being peeled than conventional Velcro® multidirectional material. Applicant submits that, based on knowledge and experience with fabrics and bedding, movement of a mattress components of a bed (e.g., on a movable support) and/or movement of a person on a bed (e.g., rolling over while sleeping) are both quieter using the noted fabrics than using the noted Velcro® materials.

Of course, if the frictional characteristics of a selected fabric were to change, then a desired minimal size of the first and second friction enhancing fabrics could also change accordingly, perhaps proportionally. Generally, the higher the frictional grip, the lower the required area of interface between friction enhancing fabrics assuming the same weights are employed. For the tested materials, it is expected that a one-inch-wide strip of friction enhancing fabric around the perimeter of a queen-sized mattress (about 5% of the surface area) would suffice to hold a topper to a mattress. If desired, two- or three-inch-wide perimeter strips would offer about 2 or 3 times the coverage and holding force required to move the elements laterally. Similarly, two two-inch wide strips across a queen-sized mattress would provide about 5% coverage of the surface area. Proportionally more strips and/or wider strips would provide more coverage and more frictional holding to overcome before movement is possible. Again, if more material is used, the frictional coefficient of the material chosen may be lower, along the lines noted above. Thus, reasonably thin and light or medium weight friction enhancing fabrics may be chosen that do not interrupt or may an uncomfortable or an unappealing mattress or topper surface while still holding a topper to a base, for example, without added connectors. The characteristics of the fabric, its desired location on the mattress components, the type of bed, cushion, or frame (fixed or movable, large or small), the expected grip required, can all be balanced in selecting a desired friction enhancing fabric pair according to the teachings above.

Thus, the disclosed subject matter provides many different types of an easy to use and user-friendly mattress arrangement, where components are held together without conventional add-on connecting structures and mentioned in the background. The resulting mattress arrangements are securely held in position, resist lateral sliding, and are easily separated by peeling, while remaining relatively quiet. This disclosure is applicable to many different indoor and outdoor mattress, bedding, and/or cushion applications, whether on furniture, supports, or vehicles, campsites, or other locations. Therefore, the disclosed concepts are not intended to be constrained to the application of any particular transmission.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

What is claimed is:

1. A mattress arrangement comprising:

a mattress base having a length, a width, and a top surface having a mattress base area defined by the mattress base length and the mattress base width, the mattress top surface including a mattress base top fabric, the mattress base having a bottom surface having the mattress base area and including a mattress base bottom fabric;

a mattress topper having a length, a width, a weight, and a bottom surface having a mattress topper area defined by the mattress topper length and the mattress topper width, the mattress topper bottom surface including a mattress topper bottom fabric, the mattress topper configured to be placed atop the mattress base in a use position so that the bottom surface of the mattress topper rests on the mattress base;

a first friction enhancing fabric permanently secured to the mattress base top surface; and a second friction enhancing fabric permanently secured to the mattress topper bottom surface;

a third friction enhancing fabric permanently secured to the mattress base bottom surface;

wherein the first friction enhancing fabric, the second friction enhancing fabric, and the weight of the topper are configured to cooperate to frictionally oppose sliding of the mattress topper relative to the mattress base when a lateral force is applied to the mattress topper solely and without requiring additional fasteners connecting the mattress topper and the mattress base so that the mattress topper is not removable from the mattress base without at least partially lifting the mattress topper off the base;

wherein a duo of the first friction enhancing fabric and the second friction enhancing fabric define a higher coefficient of friction than a duo of the mattress base top fabric and the mattress topper bottom fabric;

wherein the third friction enhancing fabric, the second friction enhancing fabric, and the weight of the topper are configured to cooperate to frictionally oppose sliding of the mattress topper relative to the mattress base when a lateral force is applied to the mattress topper solely and without requiring additional fasteners connecting the mattress topper and the mattress base so that the mattress topper is not removable from the mattress base without at least partially lifting the mattress topper off the base;

wherein a duo of the third friction enhancing fabric and the second friction enhancing fabric define a higher coefficient of friction than a duo of the mattress base bottom fabric and the mattress topper bottom fabric; and wherein the mattress base has a first firmness when in a first orientation with the top surface facing upward to contact the bottom surface of the mattress topper and a second firmness different from the first firmness when in a second orientation with the bottom surface facing upward to contact the bottom surface of the mattress topper.

2. The mattress arrangement of claim 1, wherein the first friction enhancing fabric defines a first friction enhancing fabric area, and wherein the second friction enhancing fabric defines a second friction enhancing fabric area.

3. The mattress arrangement of claim 2, wherein at least one of: the first friction enhancing fabric area is less than the mattress base area, and the second friction enhancing fabric area is less than the mattress topper area.

4. The mattress arrangement of claim 2, wherein the first friction enhancing fabric area and the second friction enhancing fabric area are substantially identical and are aligned when the mattress topper and the mattress base are in the use position.

5. The mattress arrangement of claim 2, wherein at least one of: the first friction enhancing fabric area is at least 5% as large as the mattress base area, and the second friction enhancing fabric area is at least 5% as large as the mattress topper area.

6. The mattress arrangement of claim 2, wherein at least one of the first friction enhancing fabric area and the second friction enhancing area comprise one continuous area.

7. The mattress arrangement of claim 2, wherein the mattress base is an adjustable mattress base locatable on an articulatable mattress support, the mattress base defining at least one pivot point extending across the width of the mattress base, the first friction enhancing fabric extending lengthwise above and below the at least one pivot point.

8. The mattress arrangement of claim 2, wherein at least one of: the first friction enhancing fabric area is coextensive with the mattress base area, and the second friction enhancing fabric area is coextensive with the mattress topper area.

9. The mattress arrangement of claim 1, wherein the first friction enhancing fabric and the second friction enhancing fabric have an apparent static coefficient of friction of at least 2.0 when tested laterally according to ASTM-D1894-14.

10. The mattress arrangement of claim 9, wherein the apparent static coefficient of friction is 8.5.

11. The mattress arrangement of claim 9, wherein the apparent static coefficient of friction is between 6.3 and 9.5.

12. The mattress arrangement of claim 11, wherein the first friction enhancing fabric length is 60 inches.

13. The mattress arrangement of claim 11 wherein the first friction enhancing fabric area is at least 50% as large as the mattress base top surface, and the third friction enhancing fabric area is at least 50% as large as the mattress base bottom surface, and the second friction enhancing surface area at least 50% as large as the mattress topper bottom surface.

14. The mattress arrangement of claim 11, wherein the first friction enhancing fabric area is at least 50% as large as the mattress base top surface, and the third friction enhancing fabric area is at least 50% as large as the mattress base bottom surface, and the second friction enhancing surface area at least 50% as large as the mattress topper bottom surface.

15. The mattress arrangement of claim 1, wherein the first friction enhancing fabric, the second friction enhancing fabric, and the third friction enhancing fabric each have a unit weight less than 400 gsm and a thickness of less than 6.0 mm.

16. The mattress arrangement of claim 1, wherein the first friction enhancing fabric and the second friction enhancing fabric each comprise polyester fabrics.

17. The mattress arrangement of claim 1, wherein one of the first friction enhancing fabric and the second friction enhancing fabric comprises a hook fabric.

18. The mattress arrangement of claim 17, wherein the hook fabric is a unidirectional hook fabric.

19. The mattress arrangement of claim 17, wherein the other of the first friction enhancing fabric and the second friction enhancing fabric comprises a fabric frictionally engageable by the hook fabric.

20. The mattress arrangement of claim 1, wherein the first friction enhancing fabric is attached to the mattress base top fabric, and wherein the second friction enhancing fabric is attached to the mattress topper bottom fabric, in both cases by at least one of: an adhesive or stitching.

21. The mattress arrangement of claim 1, wherein the first friction enhancing fabric, the second friction enhancing fabric, and the third friction enhancing fabric each have a unit weight less than unit weight less than 300 gsm and a thickness of 1.0 mm.

22. A mattress arrangement comprising:

a mattress base having a length, a width, and a top surface having a mattress base area defined by the mattress base length and the mattress base width, the mattress base having a top surface having the mattress base area and including a mattress base top fabric, the mattress base having a bottom surface having the mattress base area and including a mattress base bottom fabric;

a mattress topper having a length, a width, a weight, and a bottom surface having a mattress topper area defined by the mattress topper length and the mattress topper width, the mattress topper configured to be placed atop the mattress base in a use position so that the bottom surface of the mattress topper rests on the mattress base;

a first friction enhancing fabric having an area covering at least a portion of the mattress base top surface; and a second friction enhancing fabric having an area covering at least a portion of the mattress topper bottom surface;

a third friction enhancing fabric having an area covering at least a portion of the mattress base bottom surface;

wherein the first friction enhancing fabric, the second friction enhancing fabric, and the weight of the topper are configured to cooperate to oppose sliding of the mattress topper relative to the mattress base when a lateral force is applied to the mattress topper solely and without requiring additional fasteners connecting the mattress topper and the mattress base;

wherein the third friction enhancing fabric, the second friction enhancing fabric, and the weight of the topper are configured to cooperate to frictionally oppose sliding of the mattress topper relative to the mattress base when a lateral force is applied to the mattress topper solely and without requiring additional fasteners connecting the mattress topper and the mattress base;

wherein the first friction enhancing fabric and the second friction enhancing fabric have an apparent static coefficient of friction of at least 2.0 when tested according to ASTM-D1894-14;

wherein the third friction enhancing fabric and the second friction enhancing fabric have an apparent static coefficient of friction of at least 2.0 when tested according to ASTM-D1894-14; and wherein the mattress base has a first firmness when in a first orientation with the top surface facing upward to contact the bottom surface of the mattress topper and a second firmness different from the first firmness when in a second orientation with the bottom surface facing upward to contact the bottom surface of the mattress topper.

23. The mattress arrangement of claim 22, wherein the apparent static coefficient of friction is 8.5.

24. The mattress arrangement of claim 22, wherein the apparent static coefficient of friction is between 6.3 and 9.5.

25. The mattress arrangement of claim 22, wherein the first friction enhancing fabric and the second friction enhancing fabric each have a unit weight less than about 400 gsm and a thickness of less than about 6.0 mm.

26. The mattress arrangement of claim 22, wherein the first friction enhancing fabric and the second friction enhancing fabric each comprise polyester fabrics.

27. The mattress arrangement of claim 26, wherein one of the first friction enhancing fabric and the second friction enhancing fabric comprises a hook fabric.

28. The mattress arrangement of claim 27, wherein the hook fabric is a unidirectional hook fabric.

29. The mattress arrangement of claim 22, wherein the first friction enhancing fabric, the second friction enhancing fabric, and the third friction enhancing fabric each have a unit weight less than unit weight less than 300 gsm and a thickness of 1.0 mm.

* * * * *